US006732725B2

(12) United States Patent
Doud

(10) Patent No.: US 6,732,725 B2
(45) Date of Patent: May 11, 2004

(54) FIRE OUT CANISTER LAUNCHER

(76) Inventor: Alton J. Doud, 1319 Jeffwood, Waterford, MI (US) 48237

( * ) Notice: Subject to any disclaimer, the term of this patent is extended or adjusted under 35 U.S.C. 154(b) by 0 days.

(21) Appl. No.: 10/215,144

(22) Filed: Aug. 8, 2002

(65) Prior Publication Data

US 2003/0056776 A1 Mar. 27, 2003

Related U.S. Application Data

(60) Provisional application No. 60/311,032, filed on Aug. 9, 2001.

(51) Int. Cl.[7] ..... F41B 7/00
(52) U.S. Cl. ..... 124/27
(58) Field of Search ..... 124/16, 26, 27, 124/37, 83

(56) References Cited

U.S. PATENT DOCUMENTS 157,336 A * 12/1874 Lyon
183,124 A * 10/1876 Butterweck
547,394 A * 10/1895 Gardy
710,437 A * 10/1902 Daniels
1,492,898 A * 5/1924 Schmidt
2,777,436 A * 1/1957 Renner
4,696,347 A * 9/1987 Stolov et al.
5,507,350 A * 4/1996 Primlani
5,778,984 A * 7/1998 Suwa

* cited by examiner

*Primary Examiner*—John A. Ricci
(74) *Attorney, Agent, or Firm*—Arnold S. Weintraub; C. Dennis Lacina; The Weintraub Group, P.L.C.

(57) ABSTRACT

A fire-extinguishing, material-containing, launching apparatus has a bore in which a projecting or launching wall releasably seats a canister of fire-extinguishing material. The apparatus includes a hollow tube which is disposed the launching wall and biasing member such as a spring, which normally urges the wall toward an open end of the tube. The wall is restrained from movement through an actuator rod, the forward end of which defines a retention member. Guide slots provided in the tube limit the movement of the launching wall.

10 Claims, 1 Drawing Sheet

62
60
20
14
10
12
21
16
62
58
24
18

32
28
36
40
20
22
30
58
34
42
10
21
50
58
16
54
A
26
48
46
38
32
44
24
18

52
56
44
50
58
34
10
58
54
24

FIRE OUT CANISTER LAUNCHER

CROSS-REFERENCE TO RELATED APPLICATIONS

This application is a completion application of copending U.S. Provisional Application Serial No. 60/311,032, filed on Aug. 9, 2001, for "Fire Out Canister Launcher," the disclosure of which is hereby incorporated by reference.

BACKGROUND OF THE INVENTION

1. Field of the Invention

This invention pertains to apparatus for assisting in putting out fires and, more particularly, to a mechanical, spring loaded gun having a barrel for launching a fire-extinguishing canister.

2. The Prior Art

Mechanical apparatus for launching objects are disclosed in U.S. Pat. Nos. 2,777,436 to Renner; and 5,690,089 to Ward. Further, apparatus for remote fire fighting and extinguishing fires is disclosed in U.S. Pat. Nos. 4,696,347 to Stolov; 5,507,350 to Primlani; and 5,778,984 to Suwa.

There is always on ongoing need for improvements in fire fighting techniques and apparatus therefor.

SUMMARY AND OBJECT OF THE INVENTION

Accordingly, the primary object of this invention is the provision of a simple yet efficient apparatus for easily loading, aiming, and launching a canister or like object for extinguishing a fire.

According to a preferred embodiment of this invention, there is provided a fire out launcher apparatus for launching a fire extinguishing canister, the launcher apparatus comprising:

an elongated substantially cylindrical launch tube with a hollow interior and an open end for receiving and inserting the canister into the interior of the tube, first and second walls, said first wall being fixedly disposed in said interior remote to the open end, and said second wall being disposed for movement within said tube between a first position proximate to said first wall and a second position proximate to the open end of said tube, said second wall being generally planar and having a first face facing inwardly towards said first wall and a second face facing outwardly towards said open end, means disposed between said walls for forcing the second wall towards the open end of the tube, and means for releasably restraining the second wall in said first position, said means for releasably restraining including a retention member adapted to seat against the second face and restrain the second wall in the first position and be released from seated engagement and release the second wall for movement to said second position.

Preferably and according to this invention, the means for releasably restraining comprises an axially elongated actuator rod, and means for mounting the actuator rod for movement between a wall engaging position, corresponding to the first position wherein the retention member engages the second wall, and a wall releasing position. The actuator rod has a forward end portion in the form of said retention member and a rearward end portion in the form of an actuator trigger. The forward end portion of the actuator rod passes though the bore whereby the retention member may engage the second wall when the second wall is in the first position.

The means for mounting the actuator rod includes a pivot pin, the pivot pin mounting the actuator rod for rotation about its axis, a stop member which positions the actuator rod such that the axis of the actuator rod and the tube are substantially aligned and the retention member is in the wall engaging position, and means for biasing the retention member into the wall engaging position.

The means for biasing is a spring member that is connected to the medial portion of the actuator rod and to the tube structure. The spring member is disposed in the tube at a location between the pin and the retention member and could be a coil spring under compression, acting to push the actuator rod, or a coil spring under tension, acting to pull the actuator rod.

The actuator trigger is adapted to overcome the force provided by the spring member and pivot the forward end portion of the actuator rod downwardly and the retention member thereof from engagement with the second surface. This rotation moves the retention member centrally of the bore, thereby allowing the second wall to be forced towards the open end by the coil spring.

Preferably and according to this invention the launch tube includes a pair of axially extending guide slots, and an elongated handle having opposite hand gripping portions. The handle is connected to the second wall and the gripping portions extend through a respective guide slot to guide the forward motion of the second wall and to manually retract the second wall from the second position. The guide slots limit the forward travel of the second wall.

Further and according to this invention there is provided means gripped by one hand for positioning and aiming the forward end portion of the launch tube when the trigger is gripped by the second hand. The means for positioning and aiming comprises a handle grip foldably connected to the lower forward end portion of the tube and a sighting element foldably connected to the upper forward end portion of the tube. In operation the handle grip and sight element are rotated by the user from a first storage position in snug folded relation against the tube and into a second use position projecting outwardly out the tube.

Further and according to this invention, the means for forcing comprises a coil spring the opposite axial ends of which engage the first and second walls and normally biases the second wall forwardly towards the open end of the tube, and the second wall is provided with a bore that passes between the first and second faces.

BRIEF DESCRIPTION OF THE DRAWINGS

For a more complete understanding of the present invention, reference is made to the following detailed description and accompanying drawings. In the drawings, like reference characters refer to like parts throughout the several views, in which.

DETAILED DESCRIPTION OF A PREFERRED EMBODIMENT OF THIS INVENTION

According to a preferred embodiment of this invention, there is provided a simple yet efficient canister launcher apparatus, generally designated by the number 10, for easily loading, aiming, and launching a fire extinguishing canister 12.

As shown, the canister 12 is generally cylindrical and filled with a suitable fire-extinguishing material, such as baking powder or foam. Further, some canisters may include one or more external fins 14 for increasing the accuracy of the canister when launched.

Figure 1:
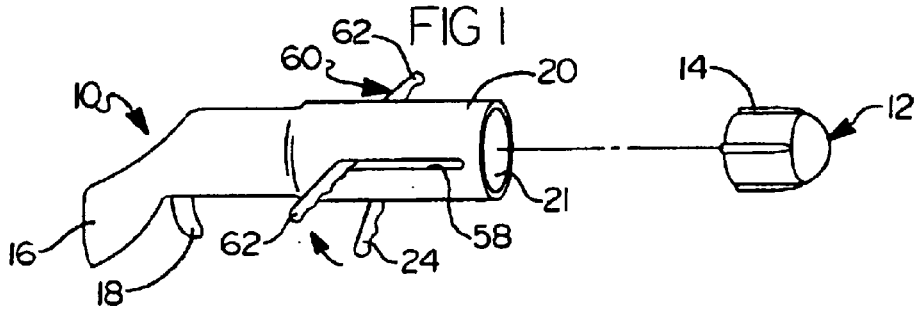
FIG. 1 is an assembly view of a fire-out canister launcher and a canister positioned proximate the forward end of the launcher, according to this invention.

The canister launcher 10 is the form of a rifle and has a stock portion 16 wherein is mounted a trigger 18, an elongated substantially cylindrical launch tube or barrel 20 with a hollow interior 22 and a forward end 22 that is open for receiving and inserting the canister 12 into the interior of the tube and launching the canister, a handle grip 24 which enables the user to position the forward end of the barrel with one hand while operating the trigger 18 with the other hand, and a sight element 25 which enables the user to aim the barrel. The handle grip 24 and sight element 25 are disposed at the forward end of the barrel and movable between a storage position in close snug-fitting relation against the barrel and a use position projecting upwardly from the barrel. In operation, the grip and sight elements 24 and 25 are rotated outwardly from their respective storage positions (see FIGS. 2 and 3) and into their respective use positions (see FIG. 1). When not in use, the grip and sight elements 24 and 25 are folded back and onto the barrel.

The stock portion 16 has a rearward end which forms a shoulder rest, and a forward end to which the rearward end of the barrel 20 is formed. The stock portion is partially hollowed out to form a cavity 26 for receiving the trigger 18 and a cylindrical recess or chamber 28 that communicates with and forms a continuation of the hollow interior of the barrel 20. Also formed interiorly of the cavity 26 is a spring chamber 30 for receiving a coil spring 32, for reasons to be described hereinbelow, and a first or vertical wall 33.

Figure 2:
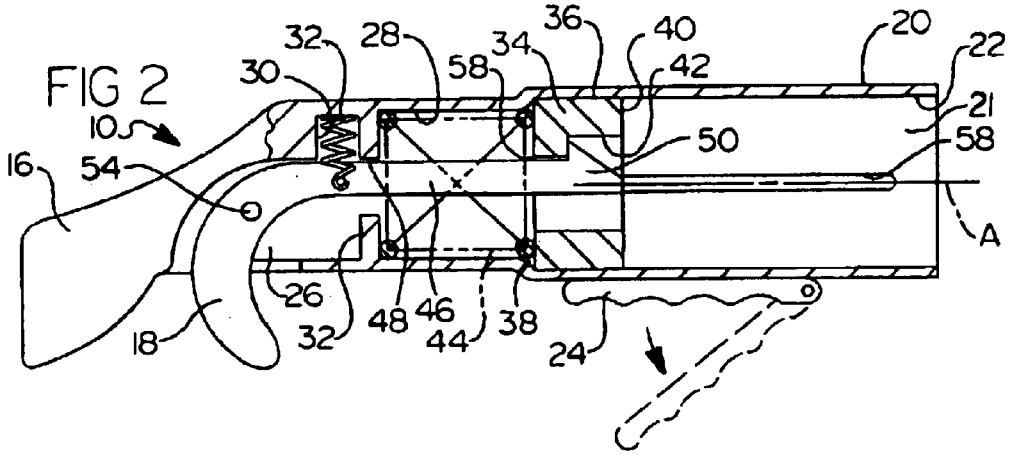
FIG. 2 is a side-elevation, in section, of the canister launcher shown in FIG. 1, without the canister but in the canister ready to launch position.
Figure 3:
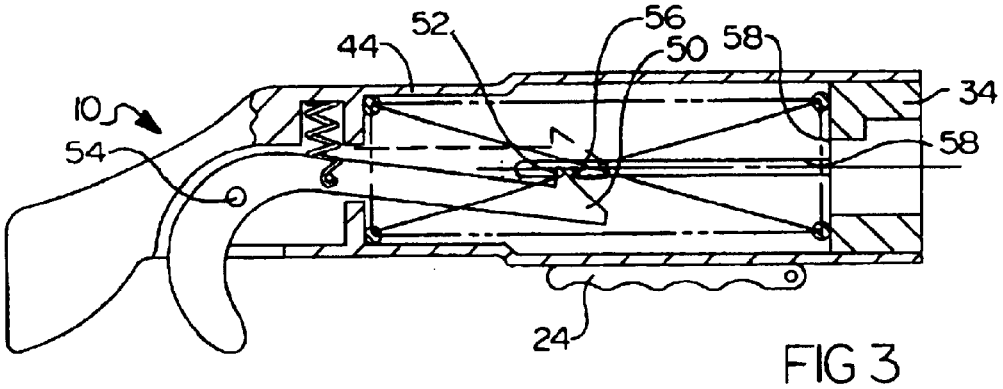
FIG. 3 is the side elevation view of the canister launcher of FIG. 2, without the canister but in the canister ready to reload position.

A generally planar cylindrical second or launch wall 34 is movably mounted in the barrel 20 for propelled movement from a first position proximate to the vertical wall 33 (as shown in FIG. 2) and into a second position proximate to the open end 21 (as shown in FIG. 3). The launch wall 34 has an outer surface 36 that is slightly less than the inner diameter of the barrel 20, a first face 38 facing rearwardly towards the vertical wall 33, a second face 40 facing forwardly and towards the open end 21, and a central bore 42 extending between the faces 38 and 40. Generally, the faces 38 and 40 are in planes that are perpendicular to the axis "A" of the barrel 20.

A coil spring 44 is disposed in the recess 28 and between the walls 33 and 34 for propelling the launch wall 34 towards the open end 21 of the barrel 20. Generally, the outside diameter of the coil spring 44 is slightly less than the interior diameter of the recess 28.

An axially elongated actuator rod 46 is disposed in the cavity 26 and pivotably mounted to the stock portion 16 whereby the actuator rod 46 may rotate from engagement with the launch wall 34 and wherein the actuator rod 46 is substantially aligned with the axis "A" of the barrel 20, also corresponding to the first position of the actuator wall 34, and to a disengaged with the launch wall position, also corresponding to the second position of the launch wall. In this regard, a transverse wall or stop member 48 is formed in the cavity 26. The stop member 48 abuts a medial portion of the actuator rod 46 and establishes the engagement with the launch wall position of the actuator rod 46.

The actuator rod 46 has a forward end portion in the form of a hook or retention member 50 and a rearward end portion in the form of the trigger 18. The forward end portion of the actuator rod 46 passes though the bore 42 whereby a transverse end face 52 of the retention member 50 is positioned to and engages the second face 40 of the launch wall 34 when the launch wall 34 is in the first position. A pivot pin 54 mounts a rearward portion of the actuator rod 46 to the stock portion 16 and for rotation relative to the pivot pin whereby the transverse end face 52 can be rotated from engagement with the launch wall.

The spring member 32, disposed in the chamber 30, has one end thereof connected to the medial portion of the actuator rod 46 and the other end connected to the stock portion 16. The spring member 32 is disposed in the cavity 26 at a location between the pivot pin 54 and the stop member 48 and is a coil spring, under tension, and acts to pull the actuator rod 46 towards the stop member 48. The spring member 32 could also be a spring under compression, acting to push the actuator rod towards the stop member 48, or other than a coil spring.

A cam surface 56 is formed on the forward end of the actuator rod 46 for releasably securing the launch wall 34 to the actuator rod 46. The cam surface 56 is at an acute angle to the axis of the actuator rod and is adapted to engage a ramped surface 58 of the shaped bore 42 through the launch wall 34, the cam surface engaging the ramped surface whereby to drive the actuator rod away from the stop member.

For launching, the retention member 50 is pulled downwardly and from engagement with the launch wall and the launch wall is released for movement. Thereafter, the spring 44 will propel the launch wall 34 towards the open end and propel the canister outwardly of the launcher.

Thereafter, for reloading, the launch wall 34 is retracted or moved rearwardly and inwardly and into the interior of the barrel. After the launch wall 34 passes inwardly and rearwardly of the retention member 50, the spring 32 pulls the actuator rod 46 upwardly and the transverse end face 52 thereof into seated engagement with the second face 40 of the launch wall.

Preferably and according to this invention an elongated handle 60 is connected to the launch wall 34 and a pair of axially elongated guide slots 58 are provide in the opposite sides of the launch barrel 20. The handle 60 is provided with a pair of hand gripping portions 62, each gripping portion extending through a respective guide slot 58 for use by the user in manually retracting the launch wall 34 from the second position for reloading. The guide slots 58 extend axially and function to guide the forward motion of the launch wall 34 during canister launching and limit the forward travel of the launch wall 34.

In operation, the user grips the handle grips 62, and pulls them rearwardly towards the stock portion 16, and against the forward bias of the coil spring 44. Due to the connection between the handle 60 and the launch wall 34, the launch wall 34 is pulled rearwardly and the central bore 42 thereof brought into engagement with the cam surface 58 of the retention member 50. Further rearward pulling action cams the retention member 50 downwardly, until the launch wall 34 is rearwardly of the end face 52. The coil spring 32 pulls the actuator rod 46 upwardly and against the stop member 48 and the end face 52 into seated engagement with the launch wall 34.

The coil spring 44 is compressed by the rearward movement of the launch wall 34 and in a launch ready position to propel the canister outwardly of the barrel.

The canister 12 is then inserted into the open end of the barrel 20 and the canister launcher 10 is ready for launching the canister. The handle grip 24 and sight 25 are lowered from their stored positions (FIG. 3) and into their in use positions (FIG. 1) and the launcher 10 then aimed.

The arcuate actuator trigger 18 is adapted to overcome the force provided by the spring member 32 and pivot the forward end portion of the actuator rod 46 downwardly and the retention member 50 thereof from engagement with the second surface 40. This rotation of the trigger 18 moves the retention member centrally of the bore 42, thereby allowing the launch wall to be propelled towards the open end by the coil spring. The guide slots 58 limit the forward movement of the launch wall 34 whereupon the launcher is ready to be reloaded.

Generally, according to the preferred embodiment, the canister launcher 10 is small, very portable, and easy to fire and reload. The stock portion is about 16 inches and the barrel 20 is about 20 inches. Further, the barrel open-end diameter is about 3 inches and the guide slot 58, or length of propelling movement of the launch wall 34, is about 16 inches. Because of this, the fire-extinguishing canister 12 is small. In this preferred embodiment, the canister has a length of about 12 inches and an outside diameter of about 3 inches, thereby enabling the user to carry many canisters at one time.

From the foregoing it is readily apparent that there has been described herein an efficacious canister launcher for issuing fire-extinguishing canisters.

Having, thus, described the invention, what is claimed is:

1. A launching apparatus, comprising:

(a) an elongated substantially cylindrical launch tube having a hollow interior and an open end for receiving and inserting a canister into the interior of the tube, (b) first and second walls, said first wall being fixedly disposed in said hollow interior remote to the open end, said second wall being disposed for movement within said tube between a first position proximate to said first wall and a second position proximate to the open end of said tube;

(c) means disposed between said first and second walls for forcing the second wall towards the open end of the tube, and (d) means for releasably restraining the second wall in said first position, said means for releasably restraining including a retention member adapted to seat against the second wall and restrain the second wall in the first position and be released from seated engagement and release the second wall for movement to said second position, an actuator rod, and means for mounting the actuator rod between a second wall engaging position corresponding to the first position and a second wall releasing position, said means for mounting comprising (1) a pivot pin, the pivot pin mounting the actuator rod for rotation about its axis, (2) a stop member which positions the actuator rod such that the axis of the actuator rod and the tube are substantially aligned and the retention member is in the wall engaging position, and (3) means for biasing the retention member into the wall engaging position, and said means for biasing comprising a spring member disposed in the tube and connected to the medial portion of the actuator rod and to the tube, the spring being disposed between the pin and the retention member end of the rod.

2. The apparatus of claim 1 wherein: the second wall is generally planar and has a first face facing the first wall and a second face facing the open end.

3. The apparatus of claim 1 wherein the actuator rod has a forward end which defines the retention member, a medial portion, and a second end which defines an actuator trigger.

4. The apparatus of claim 1 wherein:

(a) the launch tube includes a pair of axially extending guide slots, and (b) an elongated handle connected to the second wall, the handle having a portion extending through a guide slot to guide the forward motion of the second wall and to retract the second wall from the second position.

5. A fire-extinguishing material-containing canister launching apparatus, comprising:

(a) an elongated substantially cylindrical launch tube having a hollow interior and an open end for receiving and inserting a canister into the interior of the tube, (b) first and second walls, said first wall being fixedly disposed in said hollow interior remote to the open end, said second wall being disposed for movement within said tube between a first position proximate to said first wall and a second position proximate to the open end of said tube, said second wall removably seating a fire-extinguishing, material-containing canister, (c) means disposed between said first and second walls for forcing the second wall towards the open end of the tube, (d) means for releasably restraining the second wall in said first position, said means for releasably restraining including a retention member adapted to seat against the second wall and restrain the second wall in the first position and be released from seated engagement and release the second wall for movement to said second position, and (e) means for positioning and aiming which comprises (1) a handle grip foldably connected to the forward end of the tube, and (2) a sighting element foldably connected to the forward end of the tube.

6. The apparatus of claim 5 wherein: the second wall is generally planar and has a first face facing the first wall and a second face facing the open end.

7. The apparatus of claim 5 wherein the actuator rod has a forward end which defines the retention member, a medial portion, and a second end which defines an actuator trigger.

8. The apparatus of claim 5 wherein:

(a) the launch tube includes a pair of axially extending guide slots, and (b) an elongated handle connected to the second wall, the handle having a portion extending through a guide slot to guide the forward motion of the second wall and to retract the second wall from the second position.

9. A launching apparatus, comprising:

(a) an elongated substantially cylindrical launch tube having a hollow interior and an open end for receiving and inserting a canister into the interior of the tube, (b) first and second walls, said first wall being fixedly disposed in said hollow interior remote to the open end, said second wall being disposed for movement within said tube between a first position proximate to said first wall and a second position proximate to the open end of said tube;

(c) means disposed between said first and second walls for forcing the second wall towards the open end of the tube, (d) means for releasably restraining the second wall in said first position, said means for releasably restraining including a retention member adapted to seat against the second wall and restrain the second wall in the first position and be released from seated engagement and release the second wall for movement to said second position, and (e) means for positioning and aiming, which comprises: (1) a handle grip foldably connected to the forward end of the tube, and (2) a sighting element foldably connected to the forward end of the tube.

10. A fire-extinguishing material-containing canister launching apparatus, comprising:

(a) an elongated substantially cylindrical launch tube having a hollow interior and an open end for receiving and inserting a canister into the interior of the tube, (b) first and second walls, said first wall being fixedly disposed in said hollow interior remote to the open end, said second wall being disposed for movement within said tube between a first position proximate to said first wall and a second position proximate to the open end of said tube, said second wall removably seating a fire-extinguishing, material-containing canister, (c) means disposed between said first and second walls for forcing the second wall towards the open end of the tube, (d) means for releasably restraining the second wall in said first position, said means for releasably restraining including a retention member adapted to seat against the second wall and restrain the second wall in the first position and be released from seated engagement and release the second wall for movement to said second position, an actuator rod, and means for mounting the actuator rod between a second wall engaging position corresponding to the first position and a second wall releasing position, said means for mounting comprising (1) a pivot pin, the pivot pin mounting the actuator rod for rotation about its axis, (2) a stop member which positions the actuator rod such that the axis of the actuator rod and the tube are substantially aligned and the retention member is in the wall engaging position, and (3) means for biasing the retention member into the wall engaging position, said means for biasing comprising a spring member disposed in the tube and connected to the medial portion of the actuator rod and to the tube, the spring member being disposed between the pin and the retention member end of the rod.

* * * * *